United States Patent [19]

Maede et al.

[11] Patent Number: 4,989,851

[45] Date of Patent: Feb. 5, 1991

[54] METHOD AND APPARATUS FOR STACKING FABRIC STRIPS WITH SLIDE FASTENER STRINGERS

[75] Inventors: Yukio Maede, Kurobe; Akio Yunoki, Namerikawa; Masaharu Matsui, Toyama, all of Japan

[73] Assignee: Yoshida Kogyo K. K., Tokyo, Japan

[21] Appl. No.: 309,263

[22] Filed: Feb. 13, 1989

[30] Foreign Application Priority Data

Feb. 17, 1988 [JP] Japan ..... 63-35950

[51] Int. Cl.[5] ..... B41L 43/04

[52] U.S. Cl. ..... 270/41; 493/937; 83/921; 83/277

[58] Field of Search ..... 270/30, 31, 40, 41, 270/45, 52, 52.5; 493/356, 357, 937; 83/176, 206, 210, 921, 277

[56] References Cited

U.S. PATENT DOCUMENTS

| | | | |
|---|---|---|---|
| 4,250,781 | 2/1981 | Nakamura | 83/277 |
| 4,593,635 | 6/1986 | Boser et al. | 112/265.2 |
| 4,616,539 | 10/1986 | Horikawa | 83/277 |

FOREIGN PATENT DOCUMENTS

| | | | |
|---|---|---|---|
| 0115800 | 8/1984 | European Pat. Off. . | |
| 0159507 | 10/1985 | European Pat. Off. . | |
| 2041445 | 4/1971 | Fed. Rep. of Germany . | |
| 2627006 | 12/1977 | Fed. Rep. of Germany . | |
| 389535 | 7/1965 | Switzerland . | |
| 732087 | 6/1955 | United Kingdom | 493/357 |
| 1034815 | 7/1966 | United Kingdom . | |
| 1444234 | 7/1976 | United Kingdom | 83/921 |

*Primary Examiner*—Carl D. Price
*Assistant Examiner*—Therese M. Newholm
*Attorney, Agent, or Firm*—Hill, Van Santen, Steadman & Simpson

[57] ABSTRACT

A method of stacking a multiplicity of fabric strips attached with a slide fastener chain one upon another is disclosed, which comprises folding each of the strips in halves along the longitudinal axis of the fastener chain, clamping the fabric strip from both sides closely at its folded edge, cutting the trailing end of the fabric strip and depositing the thus cut fabric strip upon and in registry with a stack of previously accumulated fabric strips. An apparatus is also disclosed for carrying this method into practice, which essentially comprises a gate means having a guide slit through which a slide fastener chain is passed, a gripper means releasably gripping a leading end of the fastener chain, and a clamping means releasably clamping the fabric strip from both sides closely adjacent at the fastener chain.

7 Claims, 6 Drawing Sheets

METHOD AND APPARATUS FOR STACKING FABRIC STRIPS WITH SLIDE FASTENER STRINGERS

BACKGROUND OF THE INVENTION

1. Filed of the Invention:

This invention relates to a method of and apparatus for automatically aligning and stacking a multiplicity of strips of fabric attached with slide fastener stringers.

2. Prior Art:

There have been proposed various types of apparatus for stacking individual pieces of garment fabric one upon another which are attached with slide fasteners or fastener stringers. One such apparatus is disclosed in Japanese Laid-Open Patent Publication No. 61-203992 in which fabric strips attached with fasteners are withdrawn by a gripper at a rate timed with the speed of sewing and hung on a T-shaped stacker pivotal to and fro in the path of transfer of the strips, the strips being folded longitudinally in halves. This device, when handling relatively long garment articles such as one-piece dresses, skirts and other long apparel to which slide fasteners are applied, would encounter difficulties in that the stacker would need greater swing stroke and its location would be at a higher level, calling for a similarly high mount position of the sewing machine, and further in that because the garment strips are hung in superposed relation on the stacker, the slide fasteners thereon would become creased under the influence of the gravity of the stacked material. On the other hand, when handling relatively short or thick fabric articles, the number of layers thereof to be stacked on the stacker would be considerably limited.

SUMMARY OF THE INVENTION

Whereas, it is the primary object of the present invention to eliminate or alleviate the above-mentioned various difficulties of the prior art device.

A more specific object of the invention is to provide an improved method and apparatus for stacking a multiplicity of fabric strips with fastener stringers attached thereon one upon another neatly in alignment so as to preclude development of creases in fastener stringers and allow threading sliders therethrough with ease and accuracy.

The above and other objects and features of the invention will become apparent from the following detailed description taken in conjunction with the accompanying drawings which illustrate by way of example a preferred embodiment to which however the invention is not to be limited.

According to the invention, there is provided a method of stacking a multiplicity of fabric strips attached with slide fastener stringers one upon another in alignment, the method comprising the steps of feeding a slide fastener chain of continuous length in the longitudinal direction thereof, the chain having a series of individual fabric strips attached at predetermined intervals; folding each of the fabric strips in halves along the longitudinal axis of the fastener chain; positioning the strip tautly in alignment with a stacking table; clamping the strip from both sides closely along its folded edge; cutting the fastener chain adjacent to a trailing end of the fabric strip; tilting the cut fabric strip toward the table; and releasing the cut strip to lie flat on the table.

An apparatus of the invention to carry the above method into practice essentially comprises: a support base; a pair of support columns vertically extending at opposite ends of the base; a gate unit secured to one of the support columns and having a guide slit for passage therethrough of the slide fastener chain; a cutter provided adjacent the outlet end of the gate unit for cutting the fastener chain; a gripper reciprocally movable along a path extending between the pair of support columns and adapted to releasably engage a leading end of the fastener chain, the gripper cooperating with the gate unit in tensioning and folding the fabric strip in halves along the longitudinal axis of the fastener chain; a clamping means pivotally supported on the base and adapted to releasably clamp the fabric strip; and a stacking table supported on the base for receiving the folded fabric strips one at a time in superposed relation.

DESCRIPTION OF THE PREFERRED EMBODIMENT

Figure 1:
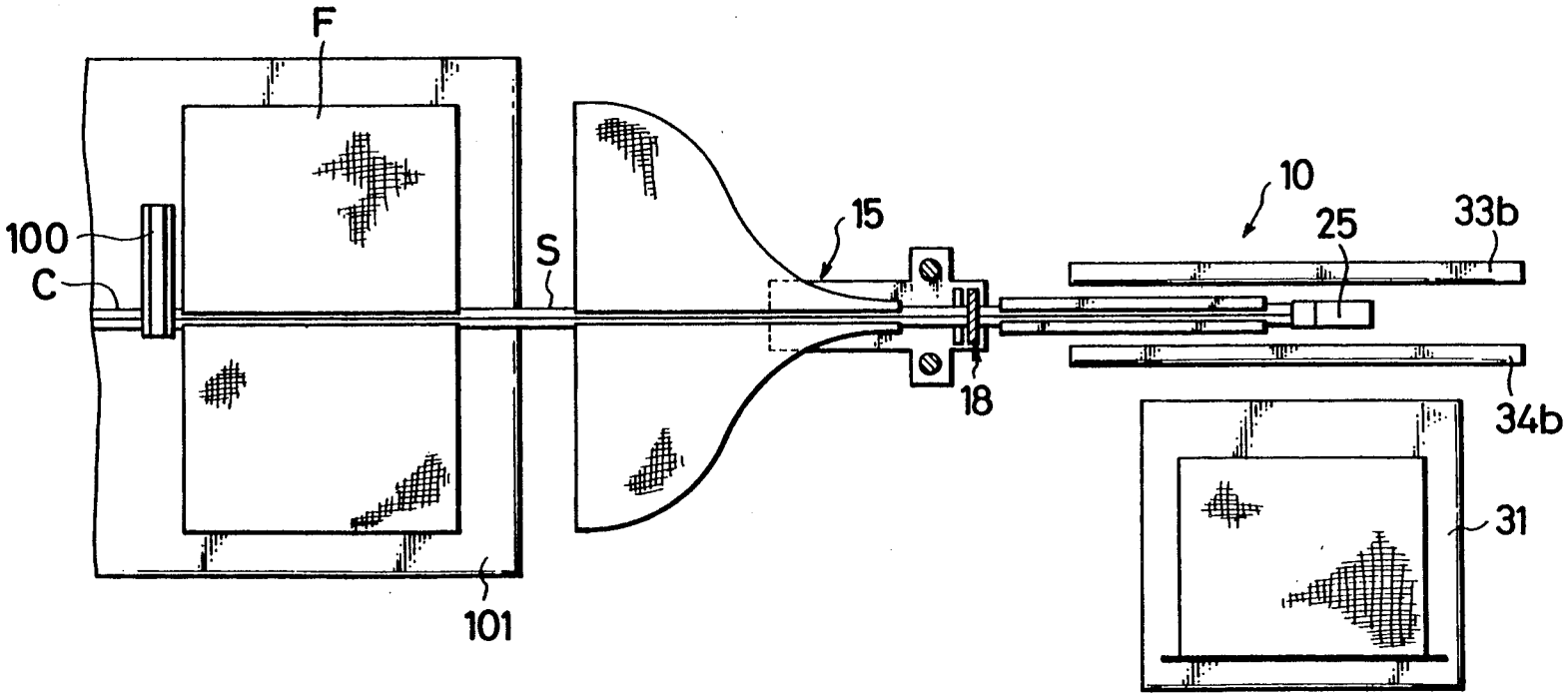
FIG. 1 is a plan view schematically illustrating the general layout of the apparatus embodying the invention.

Referring now to the drawings and FIG. 1 in particular, there is shown a stacking apparatus generally designated at 10 which is operatively associated with a sewing machine 100 at which a pair of identical strips of fabric F is sewn in the usual manner to and along the respective longitudinal edges of a continuous slide fastener chain C on a sewing table 101. Such fabric strips F are attached successively to the fastener chain C at predetermined intervals so as to leave unsewn or fabric-free sections S between adjacent strips F and are fed or transferred unidirectionally toward the stacking apparatus 10.

Figure 2:
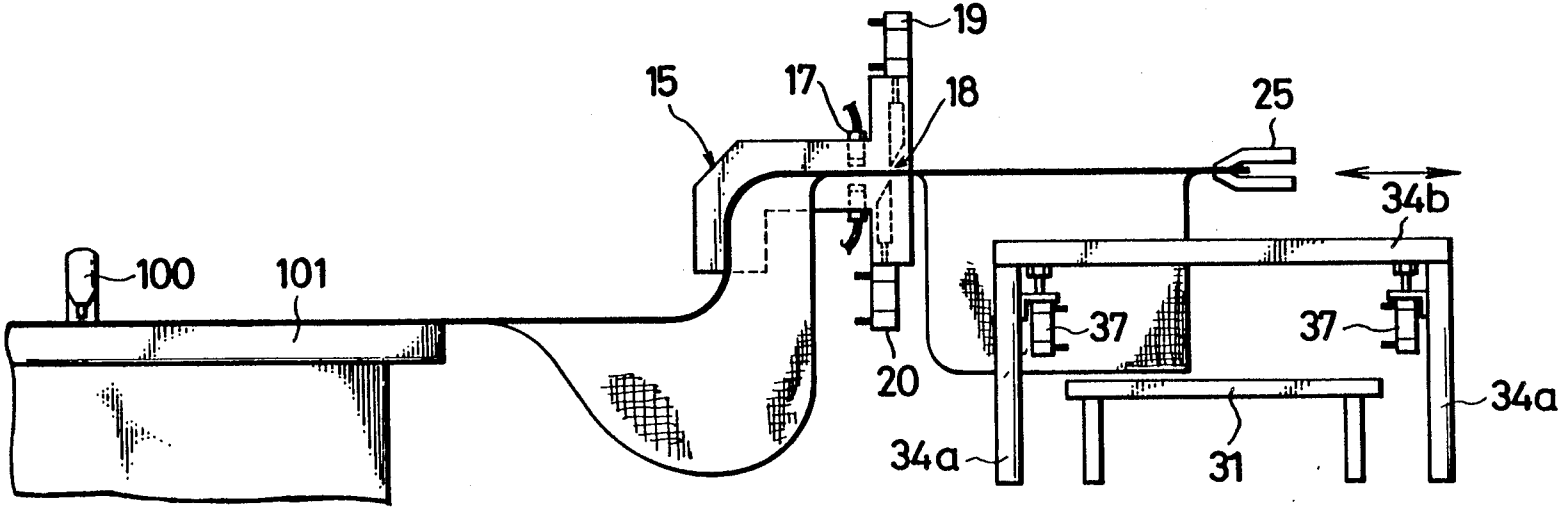
FIG. 2 is a side elevation of the same.
Figure 3:
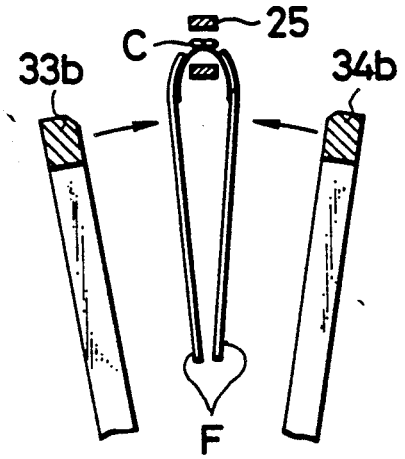
FIG. 3 is a schematic view illustrating the manner in which the folded fabric strip is clamped.
Figure 4:
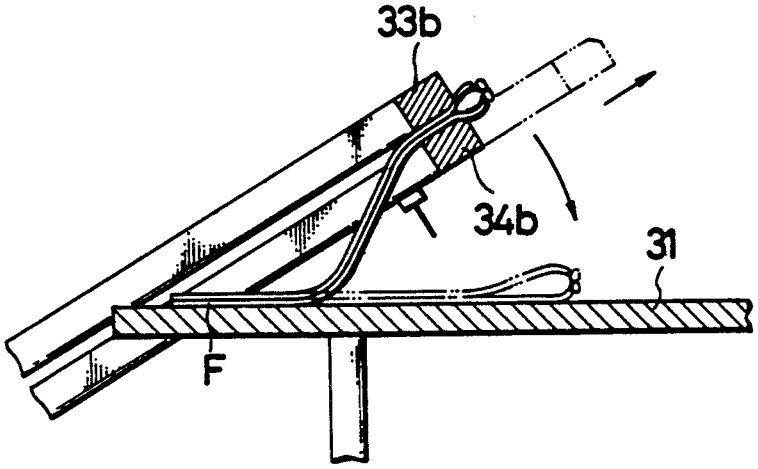
FIG. 4 is a schematic view illustrating the manner in which the clamped fabric strip is placed on a stacking table.
Figure 5:
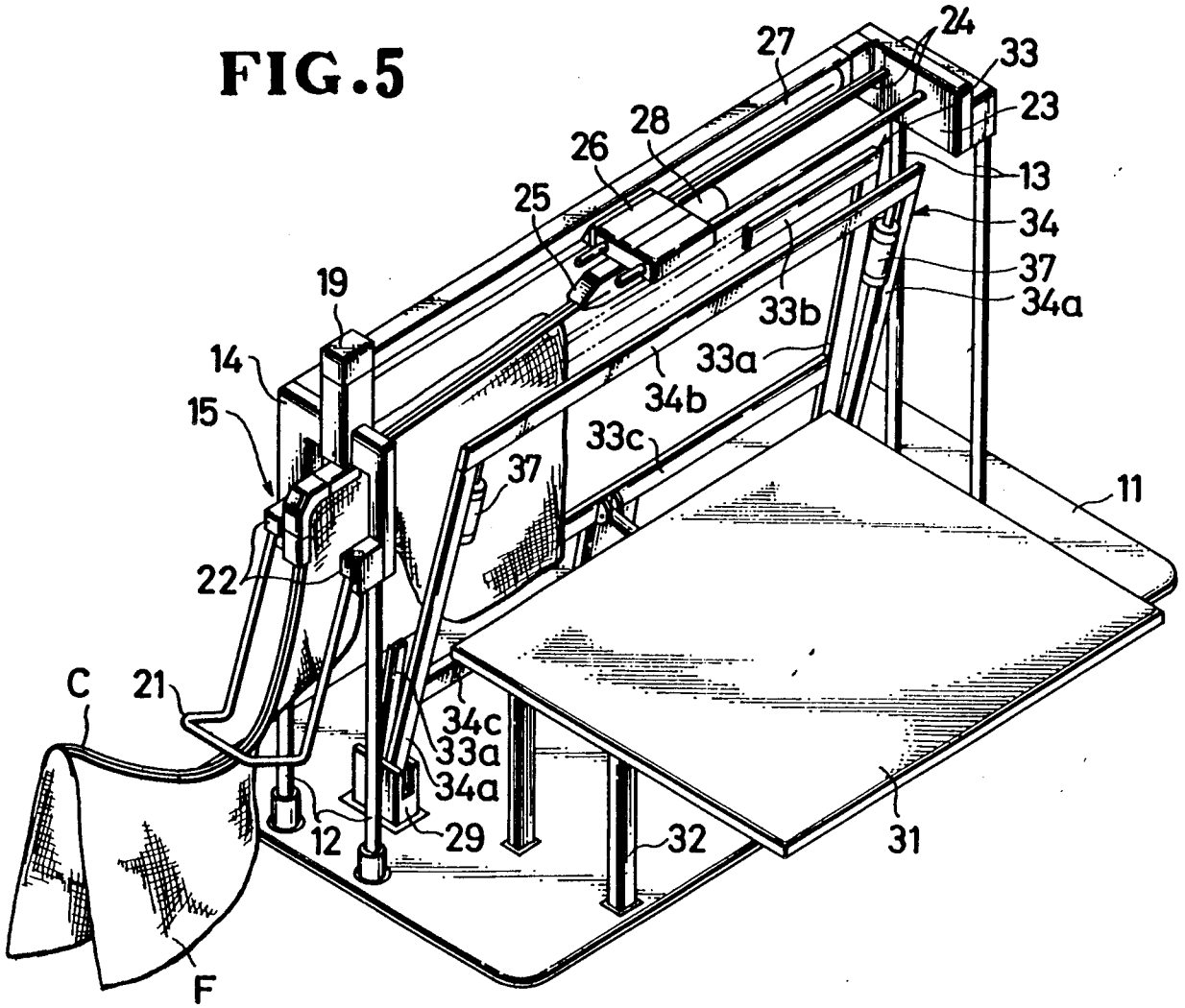
FIG. 5 is a perspective view of the apparatus according to the invention.
Figure 6:
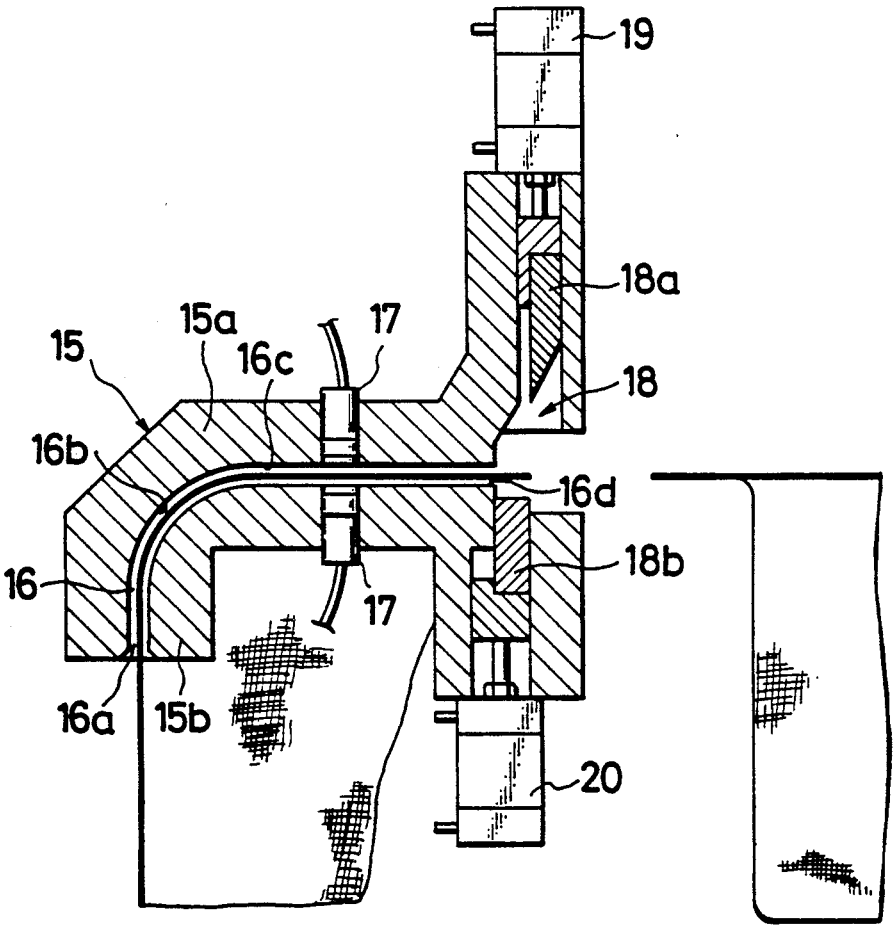
FIG. 6 is a cross-sectional view of a gate part of the apparatus of the invention.
Figure 7:
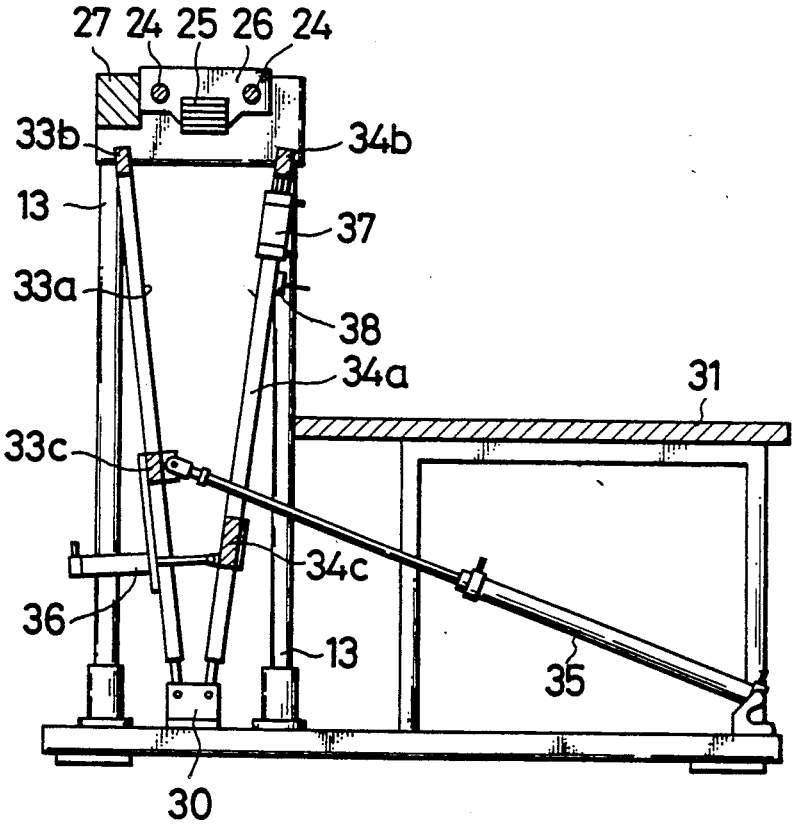
FIG. 7 is a cross-sectional view of a swing arm part of the apparatus.
Figure 8:
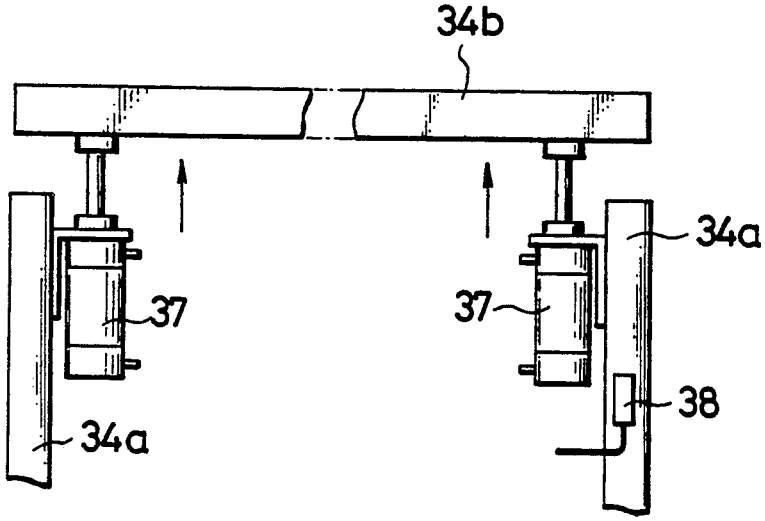
FIG. 8 is a side elevation of a clamping part of the apparatus.

Referring to FIG. 5 which better shows the general construction of the apparatus 10, there is provided a support base 11 having secured at one end a pair of vertically extending support columns 12, 12 and, at the other or opposite end, a pair of similar support columns 13, 13. A bracket member 14 is secured to the upper end of each support column 12 and adapted to hold a gate unit 15. The gate 15, as better shown in FIG. 6, includes an upper guide member **15*a* and a lower guide member 15*b* defining therebetween a guide slit 16 extending initially upwardly at an inlet 16*a*, then arcuately as at 16*b* and finally horizontally as at 16*c* to merge with a horizontal path of feed of the strips F. A sensor 17 is provided at the gate 15 in the region of the horizontal section 16*c* for detecting the fabric-free sections of the fastener chain C. Immediately adjacent to the outlet end 16*d* of the gate 15 is located a cutter 18 comprising an upper blade 18*a* and a lower blade 18*b* which are actuated by a first cylinder 19 and a second cylinder 20, respectively in response to a signal from the sensor 17. A sensor bar 21 is pivotally connected to a limit switch 22 secured to the bracket 14. Since the speed of sewing the fabric strips F is faster than the speed of aligning the same in the apparatus 10, the fastener chain C carrying fabric strips F is normally slackened and sagged, as shown in FIGS. 2 and 5, between the sewing table 101 and the gate 15 so that the limit switch 22 is left deenergized. However, if for some reason the speed of feeding the fabric strips C from the sewing machine 100 becomes slower than the speed of aligning the strips F past the gate 15, then the fastener chain C with strips F is stretched and tensioned between the sewing table 101 and the gate 15. It is then necessary to avoid overtension and disruption of the fastener chain C by discontinuing the subsequent aligning or forward movement of the fabric strips F past the gate 15, in which instance the sensor bar 21 is lifted in contact with stretching fastener chain C so as to actuate the limit switch 22**.

A bracket member 23 secured to the support columns 13, 13 is adapted to support a pair of guide rails 24, 24 extending in parallel up to the gate unit 15.

A gripper 25 is supported in a sliding member 26 which is driven reciprocally by a third rodless cylinder 27 toward and away from the gate unit 15. The gripper 25 is operated by a fourth cylinder 28 to open and close vertically so as to release and grip the leading end of the fastener chain C.

A pair of support brackets 29 and 30 are secured to the base 11 at opposite ends thereof and spaced apart by a distance greater then the width of a stacking table 31 supported on the base 11 via legs 32.

A pair of swing arms 33 and 34 each generally in the form of a square frame are supported in the brackets 29, 30, each swing arm comprising oppositely disposed vertical bar members 33*a*, 33*a* (34*a*, 34*a*) pivotally connected at their lower ends to the brackets 29, 30, an upper horizontal bar member 33*b* (34*b*) extending between and interconnecting the upper ends of the vertical bar members 33*a*, 33*a* (34*a*, 34*a*) and a lower horizontal bar member 33*c* (34*c*) extending between and interconnecting the lower portions of the vertical bar members 33*a*, 33*a* (34*a*, 34*a*). The lower bar member 33*c* is connected to and driven by a fifth cylinder 35 to rotate the swing arm 33, and the lower bar member 34*c* is connected to and driven by a sixth cylinder 36 to rotate the swing arm 34, the arrangement being that the two swing arms 33 and 34 are pivotal in opposite directions to move toward each other so that their respective upper bar members 33*b*, 34*b* clamp therebetween the fabric strip F closely adjacent to fastener chain C and to move away from each other so as to release the fabric strip F. At the upper end of each of the vertical bar members 34*a*, 34*a* is provided a seventh cylinder 37 which is connected to and adapted to displace the upper horizontal bar member 34*b* upwardly with respect to the mating bar 33*b* so as to release the fabric strip F on the table 31. Adjacent to the lower end of the seventh cylinder 37 is a sensor 38 which is adapted to monitor the thickness to which the folded fabric strips F are accumulated on the stacking table 31.

The operation of the apparatus 10 begins with threading the fastener chain C through the guide slit 16 of the gate 15 until its leading end emerges in the path of the gripper 26 and is gripped thereby as shown in FIGS. 1 and 5. The gripper 15 is then retracted or moved toward the right as viewed in the drawing until the fabric strip F is brought to a position aligning or registering with the center of the stacking table 31, in which position the fastener chain C is held taut between the gate 15 and the bracket 23 with the fabric strip F draped down and folded in halves about the longitudinal axis of the chain C. The sensor 17 contacts the fabric-free section S of the fastener chain C and transmits a signal so as to operate the swing arms 33, 34, when the upper horizontal bars 33*b*, 34*b*, move toward each other and clamp therebetween the strip F closely at the folded edge thereof. The cutter 18 then severs the fastener chain C across its fabric-free section S, whereupon the swing arms 33, 34 tilt toward the table 31 and lay the folded fabric strip F flat on the table 31. The cylinders 37, 37 now operate to move the upper horizontal bar 34*b* upwardly apart from the vertical bars 34*a*, 34*a* so that the fabric strip F is released and placed neatly on the table 31. This cycle of operation repeats itself automatically to stack individual fabric strips F one upon another in alignment on the table 31, during the course of which operation the timing of releasing the folded strip F from between the upper bars 33*b* and 34*b* becomes faster progressively the more the layers of strips F are deposited on the table 31.

Many changes and modifications may be made in the above described embodiment of the invention as appear apparent to one skilled in the art without departing from the scope of the appended claims.

What is claimed is:

1. A method of stacking a multiplicity of fabric strips attached with a slide fastener chain one upon another in alignment, which method comprises the steps of feeding a slide fastener chain in its longitudinal direction, said chain having a series of individual fabric strips attached at predetermined intervals; folding each of said fabric strips in halves, juxposed to each other, along the longitudinal axis of said fastener chain; positioning said strip tautly in alignment with a stacking table; clamping said strip from both sides closely along its folded edge; cutting said fastener chain adjacent to a trailing end of said strip; tilting the cut strip toward the stacking table; and releasing the cut strip to lie flat on the table.

2. An apparatus from stacking a multiplicity of fabric strips attached with a slide fastener chain one upon another in alignment, which apparatus comprises:

(i) a support base;

(ii) a pair of support columns vertically extending at opposite ends of said base;

(iii) a gate unit secured to one of said support columns and having a guide slit for passage therethrough of the slide fastener chain;

(iv) a cutter provided adjacent the outlet end of said gate unit for cutting the fastener chain;

(v) a gripper reciprocally movable along a path extending between said pair of support columns and adapted to releasably engage a leading end of the fastener chain, said gripper cooperating with said gate unit in tensioning and folding the fabric strip in halves along the longitudinal axis of the fastener chain;

(vi) a clamping means pivotally supported on said base and adapted to releasably clamp the fabric strip; and (vii) a stacking table supported on said base for receiving the folded fabric strips one at a time in superposed relation.

3. An apparatus according to claim 2 wherein said guide slit is arcuately shaped to allow the fastener chain to enter from under said gate unit and then pass horizontally in alignment with the path of said gripper.

4. An apparatus according to claim 2 wherein said clamping means comprises a pair of horizontal bars movable toward and away from each other to releasably clamp therebetween the fabric strip closely at the folded edge thereof, both bars being pivotable with the folded fabric strip toward said stacking table, and one of said bars being displaceable upwardly with respect to the other.

5. An apparatus according to claim 2 further including a sensor for detecting and signaling the position of the fastener chain at which the latter is free of the fabric strip.

6. An apparatus according to claim 2 further including a sensor for detecting overtension of the fastener chain to discontinue the operation of the apparatus.

7. An apparatus according to claim 2 further including a sensor for monitoring the thickness to which folded fabric strips are accumulated on said stacking table.

* * * * *